US006378537B1

(12) United States Patent
DeHart

(10) Patent No.: US 6,378,537 B1
(45) Date of Patent: Apr. 30, 2002

(54) DINING TABLE WITH INTEGRAL DISHWASHER

(76) Inventor: Harold F. DeHart, 5512 Redwood Rd., Durham, NC (US) 27704

( * ) Notice: Subject to any disclaimer, the term of this patent is extended or adjusted under 35 U.S.C. 154(b) by 116 days.

(21) Appl. No.: 09/590,557

(22) Filed: Jun. 9, 2000

(51) Int. Cl.[7] ..... A47L 15/42
(52) U.S. Cl. ..... 134/115 R; 134/200
(58) Field of Search ..... 134/115 R, 88, 134/89, 200

(56) References Cited

U.S. PATENT DOCUMENTS

| | | | | |
|---|---|---|---|---|
| 1,952,568 A | | 3/1934 | Schapp et al. | |
| 2,750,611 A | * | 6/1956 | Chatel | 134/115 R |
| 2,782,426 A | | 2/1957 | Townsend | |
| 2,886,837 A | * | 5/1959 | Schara | 134/115 R |
| 2,971,519 A | | 2/1961 | Willson | 134/58 R |
| 3,152,599 A | | 10/1964 | Grimes | 134/115 R |
| 3,605,769 A | | 9/1971 | Bagwell | 134/115 R |
| 5,687,752 A | | 11/1997 | Boylan | 134/115 R |

* cited by examiner

*Primary Examiner*—Philip Coe
(74) *Attorney, Agent, or Firm*—Olive & Olive, P.A.

(57) ABSTRACT

The invention provides a dining table including an integral dishwasher unit. A hinged access cover to the dishwasher is provided in the dining surface and adapted for being recessed below the dining surface while the user is dining. A tray that is stored in the dishwasher is moved upwardly and positioned flush with the dining surface for dining. A perforate chute extending from below the dining surface into the dishwasher is used for placing and retrieving dishes and for storing dishes during washing. A lower access door is used to place pots and other large utensils into a second compartment in the dishwasher. Each portion of the dishwasher has its own water distributor arm.

14 Claims, 4 Drawing Sheets

DINING TABLE WITH INTEGRAL DISHWASHER

FIELD OF THE INVENTION

This invention relates to the field of dishwasher apparatus, and more particularly to such apparatus in combination with a dining table or counter surface.

BACKGROUND OF THE INVENTION

Most contemporary homes have an automatic dishwasher that is installed beneath a counter surface in the home's kitchen in place of a storage cabinet. With such a dishwasher arrangement, dishes must be removed from the eating table and carried to the dishwasher to be washed. Frequently, similar types of dishes, e.g. dinner plate, salad bowl, etc., are used for many meals. After the dishes are washed, and before a subsequent meal is eaten, the dishes must be moved again to the table. In this arrangement, not only does the dishwasher occupy kitchen space that could otherwise be used for storage but also one must move the dishes back and forth between the counter and the table.

In some homes, a dishwasher is portable, that is, not installed at all, but moveable around the kitchen floor. A portable dishwasher solves the storage space drawback of the built-in dishwasher noted above. but it occupies extra floor space. If the portable dishwasher is located near the kitchen sink, it again requires transporting the dishes to and from the table for washing. If the portable dishwasher is located near the table, then a power cord, a water line, and a waste line need to traverse from a wall source across the kitchen floor.

It is also known to position a dishwasher beneath the dining surface of a table in the kitchen, thus overcoming all the obstacles of the conventional built-in as well as portable dishwashers as discussed above. The typical dining table covers an open area of unused space. The dining table is, by definition, the venue for eating. Placing a dishwasher device under a dining table avoids the need to transport the dishes to and from the table, allows more space beneath the kitchen counter for storage, and does not require electric and water lines to traverse the kitchen floor, since they can be routed directly from below the table.

In addition to the benefits of a dishwasher that is built into a dining table noted above, such an arrangement would be of particular benefit to physically handicapped or elderly persons who would be likely to have more than average difficulty with moving the dishes between the table and the dishwasher.

Such a washing apparatus built into a dining table is disclosed in U.S. Pat. No. 1,952,568 to Schapp et al. for a Convertible Dishwashing Dinner Table. The Schapp et al. disclosure includes a series of eating trays that mount into the surface of the table. The trays may be formed with cavities to receive food. The user attaches utensils and dishes to clips on the trays and inverts the tray so that its eating surface faces down for being washed. The non-eating surface does not get washed.

A further washing apparatus in a dining table is taught in U.S. Pat. No. 2,782,426 to Townsend for a Table Having Reversible Tray Mounted Therein. The Townsend table incorporates trays into its top surface. The trays are moveable from an eating position to a washing position by rotating around a mounting shaft. Only the eating surface is subject to being washed.

An additional combination dining table and dishwashing apparatus is shown in U.S. Pat. No. 2,971,519 to Willson, titled Combined Dining Table And Dishwasher. The apparatus of Willson provides a dish and utensil compartment within a storage base of the table. A dishwashing unit operates to wash the dishes that are placed on holders in the compartment. The Willson patent does not incorporate a tray component.

A still further combination dishwasher and dining table is disclosed in U.S. Pat. No. 5,687,752 to Boylan, entitled "Dining Table Having Integral Dishwasher." The device of the Boylan patent has a washing basin with a vertically shiftable rack assembly for carrying dishes. A shifting mechanism is coupled with the rack assembly for shifting the rack between a position below the table top to a position above the table top. A lid is carried up and down with the rack by the shifting mechanism. While the invention disclosed in the Boylan patent incorporates some of the basic features of the present invention, it provides a comparatively complex apparatus that has an added undesirable possibility of discharging water onto the table top if opened at the wrong time in its cycle. Boylan does not present an eating tray as part of the disclosed invention.

The present invention, in addition to addressing the need for storage space, saved steps, and utility lines across a kitchen floor also provides a more simple mechanism that is not likely to wet the dining table surface than the invention of the known prior patents. The present invention also provides an eating tray and a storage position therefor within the dishwasher unit so that both the surfaces of the eating tray are washed.

Therefore, it is an object of the present invention to provide a dining table with an integral dishwasher that is simple to manufacture and operate.

It is a further object of the present invention to provide a dining table with an integral dishwasher that allows the electric and water lines; to be hidden from view.

It is a still further object of the present invention to provide a dining table with an integral dishwasher that is unlikely to wet the dining surface if opened during its cleaning cycle.

It is an additional object of the present invention to provide a dining table with an integral dishwasher that incorporates an eating tray that is moveable between an eating position flush with the table top and a storage position within the dishwasher unit so that both surfaces of the tray are simultaneously washed.

These and other objects of the present invention will become more apparent through the disclosure of the invention to follow.

SUMMARY OF THE INVENTION

A dining table is provided with an integral dishwasher permanently installed beneath the dining surface. An access cover removeably resides in the dining surface to allow the user to place dishes into and remove dishes from the dishwasher unit. A dining tray is removeably stored within the dishwasher normally to be washed when dishes are washed. The dining tray is configured to replace the dishwasher access cover during dining times. The electrical, water, and waste utility lines are routed to the dishwasher unit from the floor beneath the dining table.

BRIEF DESCRIPTION OF THE DRAWINGS

In order for the invention to become more clearly understood it will be disclosed in greater detail with reference to the accompanying drawings, in which.

DESCRIPTION OF THE PREFERRED EMBODIMENT

Figure 1:
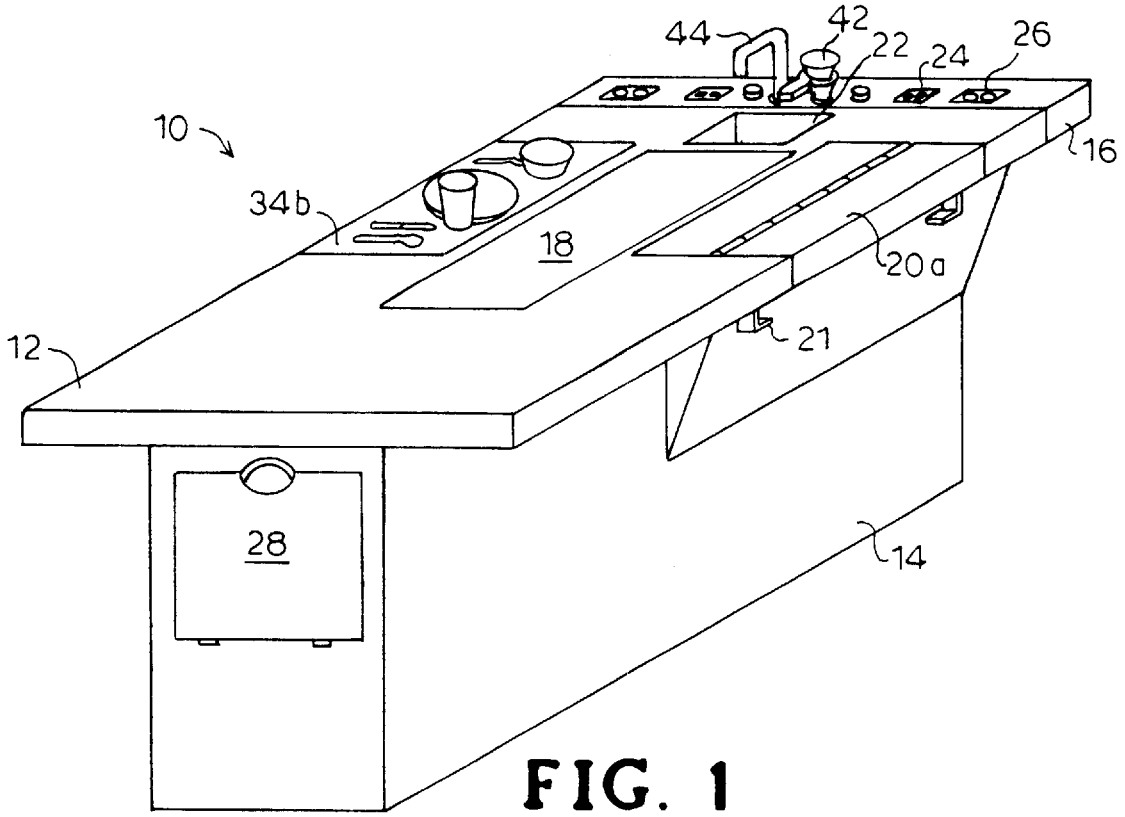
FIG. 1 is a perspective illustration of the dining table of the present invention including an integral dishwasher apparatus.

In accordance with the objects disclosed above, FIG. 1 illustrates table 10 of the present invention including an integral dishwasher. Table 10 is formed generally of a top portion comprised of dining surface 12 and utility panel 16 mounted on support base 14. Since the present invention was developed for reasons of efficiency and ease of use, table 10 is substantially permanently mounted in a selected location, and water, a waste line, and electricity are appropriately connected to the enclosed dishwasher unit. Dining surface 12 contains sink 22 and control panel 16, which has electrical outlet 26 and a series of dials 24 or switches for operating the dishwasher and an optional warming surface 18. A heating coil 18' is located beneath warming surface 18 (see FIG. 2). Additional optional controls, such as room lights or television, may be similarly installed in control panel 16. It is to be noted that the rectangular shape of table 10 is shown as an example, and other shapes, such as circular, would satisfy the criteria of the invention.

Dining surface 12 is configured to accommodate at least 2 people. Accordingly, a first access cover 20*a* is in a position where a first person is to be seated at table 10. A second access cover 20*b* (not shown) is stored beneath the plane of eating surface 12, and eating tray 34*b* is positioned in its place. A pair of mirror image support hooks 21 extends below dining surface 12 in a position for receiving and holding access cover 20*a* in a storage position, as will be described below. Tray 34*b* is mounted substantially flush with the top of dining surface 12 and is illustrated with a typical set of dishes and utensils placed for use. Table 10 is sized to accommodate additional people seated near the left end of table 10, as drawn. Access covers 20*a* and 20*b* are adapted to open and expose the operative portion of the dishwasher below, as will be described below. Sink 22 is equipped with an electrically heated water spigot 42 (as is known) for making instant coffee, tea or soup, in addition to the usual water connection 44. A pot insertion door 28 is located at the left end of supporting base 14 for placing larger cooking and serving utensils into the dishwasher unit of the invention.

Figure 2:
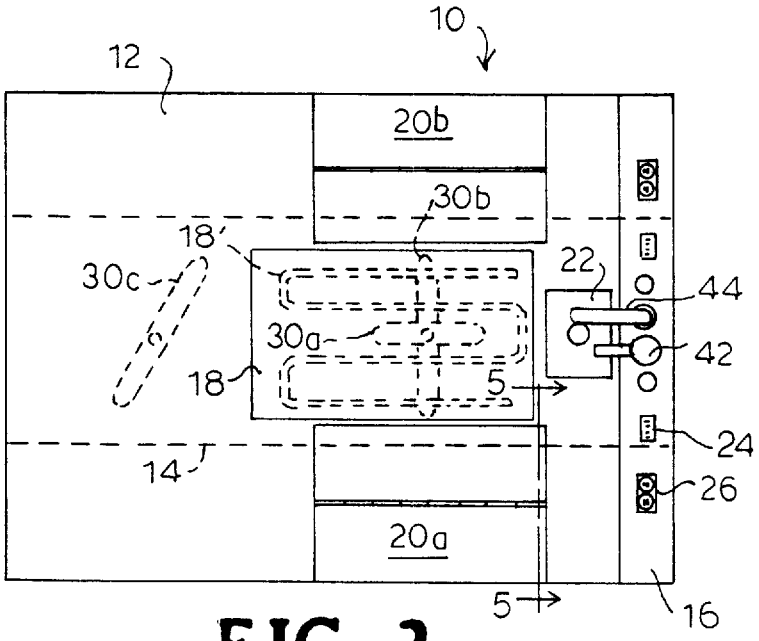
FIG. 2 is a top plan view of the dining table with an integral dishwasher of FIG. 1.

Referring now to FIG. 2, dining table 10 of the invention is shown in top plan view with certain of the internal components illustrated in dashed lines. Dish-washing water-distributor arm 30*a*, tray-washing water-distributor arm 30*b* and pot-washing water-distributor arm 30*c* are positioned within support base 14 in separated locations along a substantially central line (not shown) that is parallel to the long dimension of the invention dining table with integral dishwasher. Tray-washing water-distributor arm 30*a* is relatively small and is positioned high, and dish-washing water-distributor arm 30*b* is relatively large and is positioned low, as will be seen below with respect to FIGS. 5–8. Hot surface 18, in which heating element 18' is enclosed, is located in dining surface 12, in a location between access covers 20*a* and 20*b*. Hot surface 18 is preferably of a different appearance than dining surface 12 for visibility and safety reasons.

Figure 3:
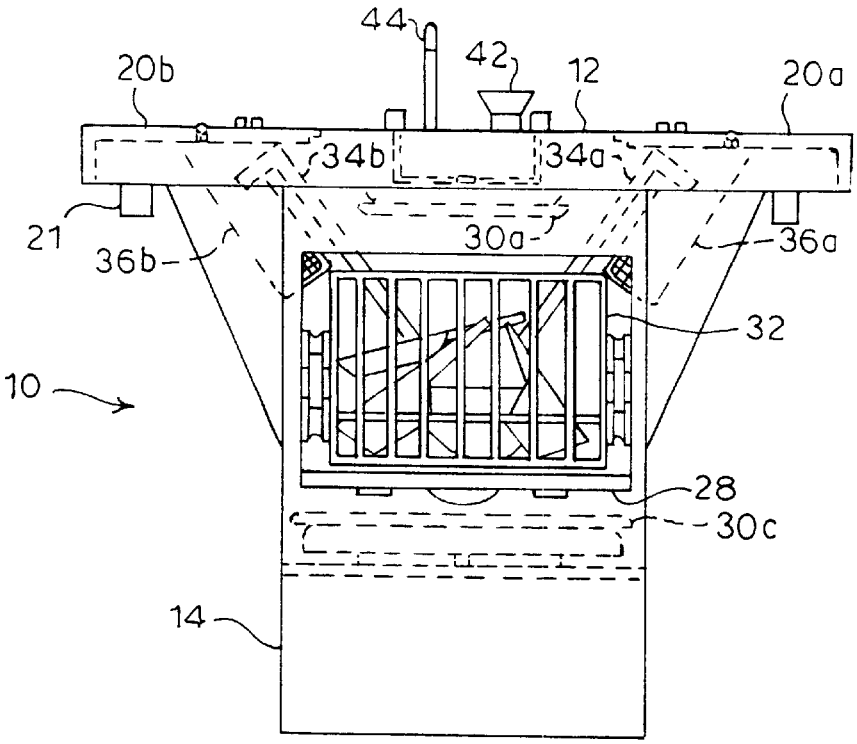
FIG. 3 is an end view of the present invention with an access door to a pot cleaning basket in the open position.

Referring now to FIG. 3, a side elevation of the relation of angularly oriented chutes 36*a* and 36*b* is shown with pot insertion door 28 open. The upper side panels on the left and right sides (as shown) of support base 14 are oriented angularly to accommodate the shape of perforate chutes 36*a* and 36*b*. Chutes 36*a* and 36*b* each provide a perforate storage housing for dishes and utensils. Chutes 36*a* and 36*b* are made of a mesh through which water can pass to permit thorough washing. A pair of eating trays 34*a* and 34*b* are shown in their stored locations between chutes 36*a* and 36*b* within support base 14. When access covers 20*a* and 20*b* are open, one may reach through the opening formed and retrieve eating trays 34*a* and 34*b* respectively for use as will be more fully described below. Eating trays 34*a* and 34*b* are configured to be supported so as to reside substantially flush with the plane of dining surface 12 when in their operating locations. At the completion of a meal, eating trays 34*a* and 34*b* are placed in their storage locations adjacent dish washing chutes 36*a* and 36*b*, where dishes are placed for washing. When all dishes and trays are in their respective positions for washing, access covers 20*a* and 20*b* are closed securely. The dishwasher unit is operated to wash trays 34*a* and 34*b* with the dishes that have been placed in chutes 36*a* and 36*b*.

Figure 4:
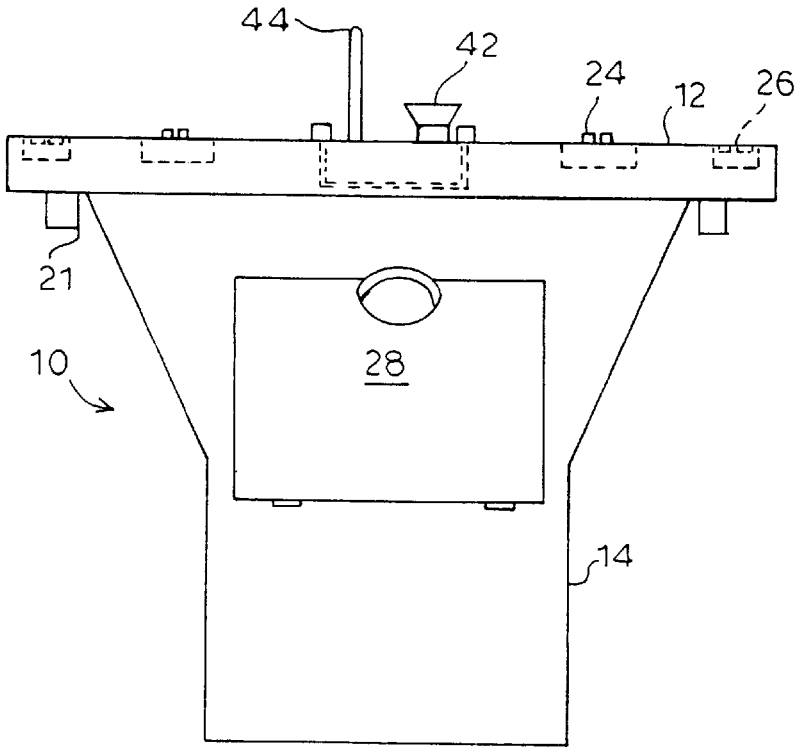
FIG. 4 is an end view of the present invention with the access door closed.

FIG. 4 shows an end view of dining table with integral dishwasher 10 as seen in FIG. 3, but with pot insertion door 28 closed.

Figure 5:
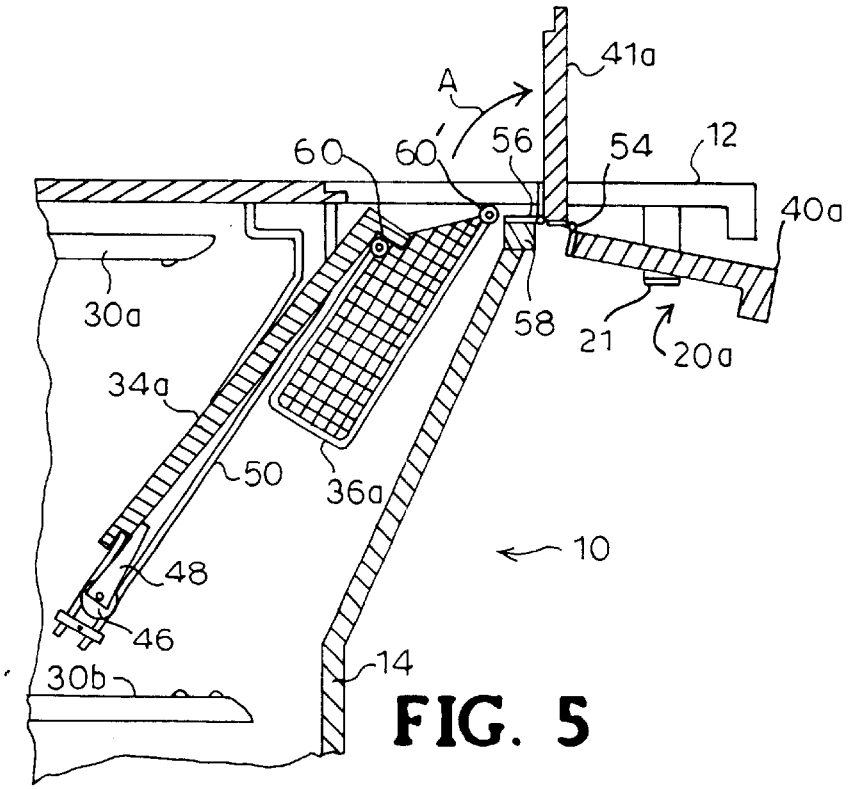
FIG. 5 is a partial sectional view of the dining table with integral dishwasher taken in the direction of line 5—5 of FIG. 2 and showing an access cover partly open.

FIGS. 5–8 illustrate the operation of the present invention through a series of sequential positions of access cover 20*a* and eating tray 34*a*. In FIG. 5, access cover 20*a* is partly removed from its resting position flush with dining surface 12. As will be seen here, access cover 20*a* is formed of outer part 40*a* and inner part 41*a*. Outer part 40*a* and inner part 41*a* are connected to each other with connecting hinge 54 that is oriented so that its pin is adjacent the respective surfaces of parts 40*a* and 41*a* that are configured to be flush with dining surface 12 when access cover 20*a* is in its closed position. Inner part 41*a* is also connected to bar 58 by pivoting hinge 56. Parts 40*a* and 41*a* are rotated around pivoting hinge 56 in the direction shown by arrow A. As outer part 40*a* moves downwardly beneath dining surface 12, support hook 21 restricts the downward movement of outer part 40*a*.

Figure 6:
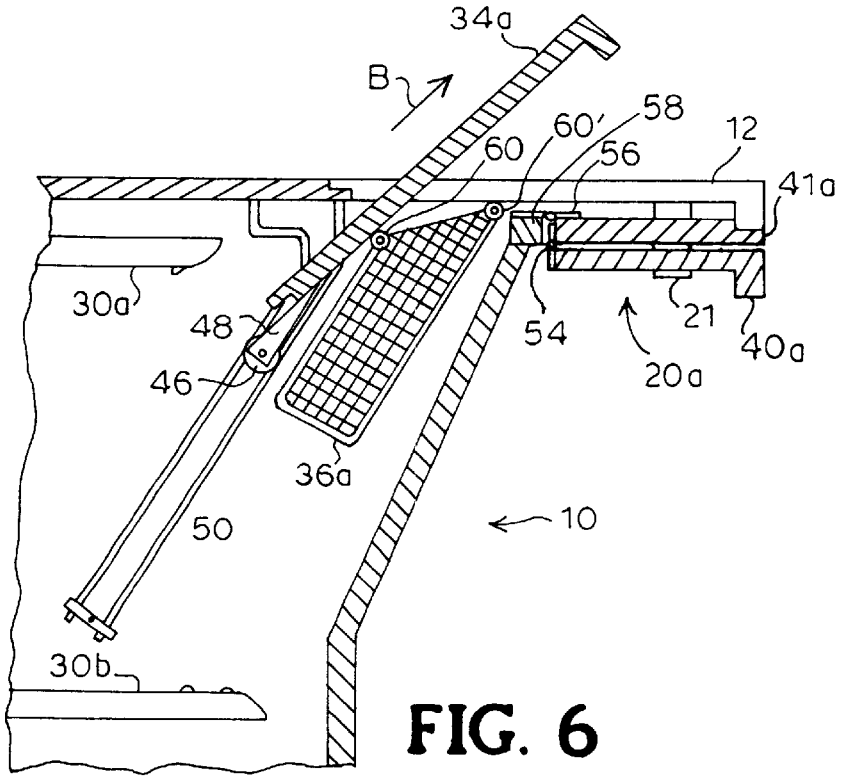
FIG. 6 is the view of FIG. 5, with the access cover fully removed and an eating tray positioned between a storage position within the dishwasher and an operative position at the dining surface.

Referring now to FIG. 6, inner part 40*a* and outer part 41*a* are shown at the completion of their rotation, residing in their storage positions beneath the plane of dining surface 12 and being supported in parallel, horizontal positions on support hook 21. At this stage, eating tray 34*a* is being moved from its storage and cleaning position within base 14, upwardly and outwardly in the direction of arrow B. Eating tray 34*a* has a guide 46, for example a roller, mounted to each of its lower corners (one shown) by bracket 48. Guide 46 is formed with a circumferential groove that engages track 50 to guide the movement of eating tray 34*a*. Track 50 is made of round rod material. in the preferred embodiment. Other forms of guide and track are available to accomplish similar control. A pair of stops 60 is mounted to the upper inner corner (one shown) of chute 36*a* and a pair of supports 60' is mounted to the upper outer corner (one shown) of chute 36*a* to be at different heights relative to eating surface 12. As illustrated in FIG. 6, guide 60 assists in guiding the movement of eating tray 34*a* out of its storage position.

Figure 7:
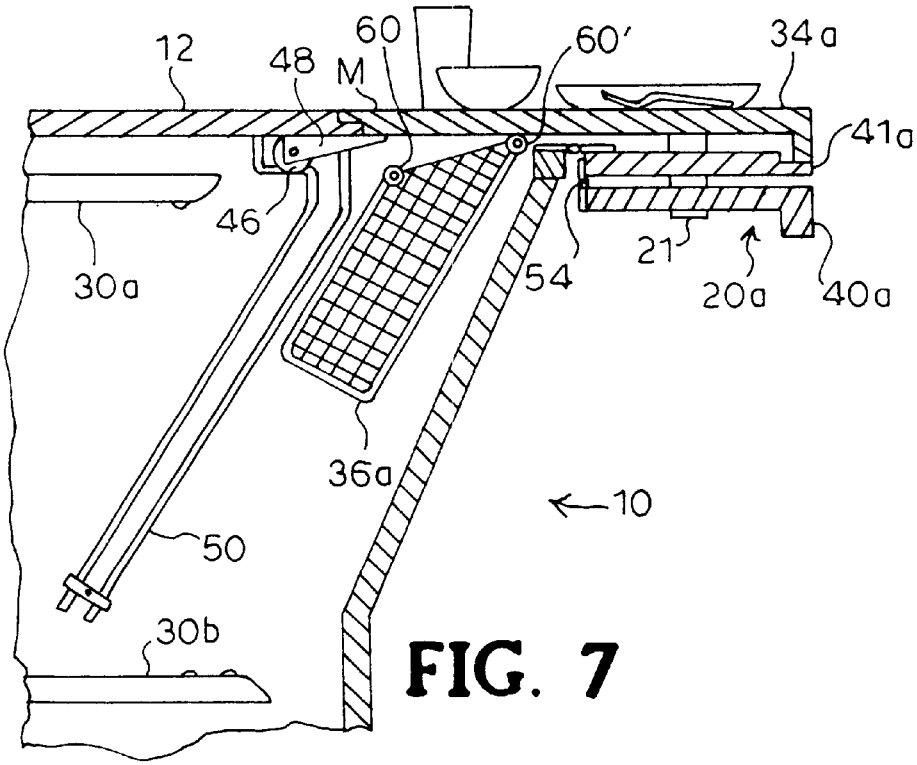
FIG. 7 is the view of FIG. 6, with the eating tray in its operative position for eating, and dishes and utensils placed thereupon for use.

FIG. 7 shows eating tray 34*a* as it is placed to provide continuity of eating surface 12. A mortised edge M is formed on the inner edge of eating tray 34*a* and the mating edge of dining surface 12 to securely locate and support the rear of eating tray 34*a*. In this position, the middle area of eating tray 34*a* rests on support 60' and the front edge thereof rests on a mating mortised edge of inner part 41*a*, thereby securely supporting eating tray 34*a* at three points. To position eating tray 34*a* flush with dining surface 12, guide 46 has been pressed into a rearwardly extending spur portion of track 50 and is pressed against the lower surface of dining surface 12 so that dining surface 12 is substantially sandwiched between guide 46 and mortised edge M.

Figure 8:
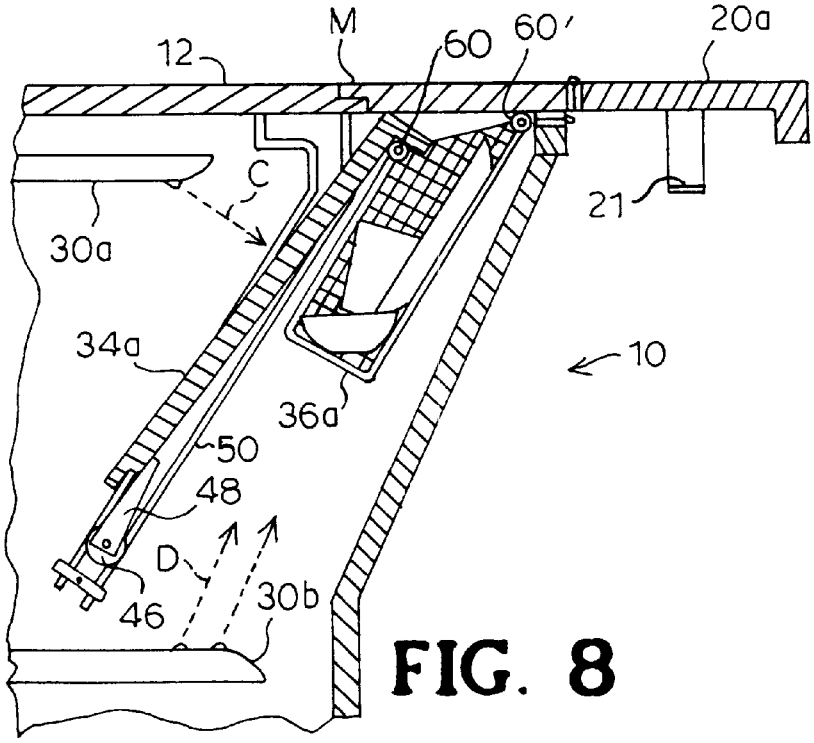
FIG. 8 is the view of FIG. 7, with the eating tray in its stored position and the access cover in place so as to enclose the dishwasher mechanism below.

FIG. 8 illustrates dining table with integral dishwasher 10 as it is ready for a washing process. Eating tray 34*a* has been returned to its storage position with guide 46 near the lower end of track 50 and the upper end of eating tray 34*a* resting on stop 60. Access cover 20*a* is positioned flush with dining surface 12 with mortised edges M of dining surface 12 and access cover 20*a* engaged. Access cover 20*a* is fitted with gasket material (not shown) so as to contain spraying water coming from water distribution arms 30*a*. A typical set of dishes is shown in perforate chute 36*a*. A locking mechanism (not shown) is provided to keep access cover 20*a* securely held in the illustrated position to prevent accidental opening during a washing cycle and so that if downward pressure exerted on the outer end thereof does not cause access cover 20*a* to dislodge.

When the dishwasher function operates, upper water distribution arm 30*a* sprays water in the direction of arrow C onto the exposed upper surface of eating tray 34*a*, and lower water distribution arm 30*b* sprays water in the direction of arrows D onto the exposed lower surface of eating tray 34*a* and the dishes in chute 36*a*. A further water distribution arm 30*c* sprays upwardly to wash pots in basket 32 (see FIG. 3).

The invention further recognizes that there are a substantial number of single person households. In such a single person situation, eating may most commonly be done at a kitchen counter rather than at a table. The present invention is readily built into a counter with a single access cover and a single chute for one-side use. Such a one-sided mechanism could similarly be built into a dining table if desired.

The above detailed description of a preferred embodiment of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A combination dining table with integral dishwasher, comprising:

(a) a. support base having a top portion;

(b) a substantially horizontal dining surface fixedly mounted on said top portion of said support base;

(c) a dishwasher assembled within said support base and connected to appropriate utilities for operation thereof;

(d) an openable access cover located proximate said dining surface and positionable in either a first storage position providing access to said dishwasher or in a second enclosing position above selected portions of said dishwasher;

(e) a perforate chute mounted within said dishwasher and configured for receiving and holding a plurality of utensils, said chute extending angularly downward from an open upper end to a closed perforate lower end thereof; and (f) wherein said access cover when in said enclosing position is flush with said dining surface and when in said storage position is below said dining surface.

2. The combination dining table with integral dishwasher according to claim 1, further comprising means for sealing selected portions of said access cover in its enclosing position over said dishwasher to prevent leakage therefrom.

3. The combination dining table with integral dishwasher according to claim 1, wherein said dining table is adapted for at least two people to use simultaneously and a second said openable access cover and a second said perforate chute.

4. The combination dining table with integral dishwasher according to claim 1 wherein said access cover is formed in two parts that are hingedly connected to each other.

5. The dining table with integral dishwasher according to claim 1, further comprising a main portion adapted for receiving and washing dishes and utensils and an auxiliary portion with a pot insertion door adapted for receiving and washing pots therein.

6. The dining table with integral dishwasher according to claim 5, wherein said main portion and said auxiliary portion of said dishwasher are each equipped with a water distributor arm.

7. The combination dining table with integral dishwasher according to claim 6 including an eating tray that is moveable between a storage position within said dishwasher and a dining position substantially flush with said dining surface, and wherein a first water distributor arm adapted for washing dishes and a first surface of said eating tray is positioned below a washing position for said dishes and said eating tray, a second water distributor arm adapted for washing pots is positioned below a washing position for said pots, and a third water distributor arm adapted for washing a second surface of said eating tray is positioned above a washing position for said eating tray.

8. A combination dining table with integral dishwasher, comprising:

(f) a support base having a top portion;

(g) a substantially horizontal dining surface mounted on said top portion of said support base;

(h) a dishwasher assembled within said support base and connected to appropriate utilities for operation thereof;

(i) an openable access cover adjacent said dining surface in a location for providing access to said dishwasher and adapted for movement between an enclosing position and a storage position;

(j) an eating tray that is moveable between a storage position within said dishwasher and a dining position substantially flush with said dining surface; and (f) further comprising means for peripherally sealing said access cover in its enclosing position over said dishwasher to prevent leakage.

9. The combination dining table with integral dishwasher according to claimed 8, wherein said eating tray is mounted such that it can be positioned when within said dishwasher so as to be washed simultaneously on both of opposite sides thereof.

10. The combination dining table with integral dishwasher according to claim 8, wherein said eating tray is formed with a guide for engaging a track mounted within said support base, said track being adapted for guiding movement of said eating tray between a storage and washing position and an eating position.

11. The combination dining table with integral dishwasher according to claim 10, wherein said guide and said eating tray are configured so that when said eating tray is in its position substantially flush with said dining surface, said eating tray and said guide engage portions of said dining surface and securely support said eating tray.

12. The combination dining table with integral dishwasher according to claim 8, wherein said access cover and said eating tray each occupy an opening in said dining surface at alternate times.

13. A combination dining table with integral dishwasher, comprising:

(a) a support base having a top portion;

(b) a substantially horizontal dining surface mounted on said top portion of said support base;

(c) a dishwasher assembled within said support base and connected to appropriate utilities for operation thereof;

(d) an openable access cover located proximate said dining surface in a location for providing access to said dishwasher and adapted for movement between an enclosing position flush with said dining surface and a storage position below said dining surface;

(e) a perforate chute mounted within said dishwasher and configured for receiving and holding a plurality of utensils, said chute extending angularly downward from an open upper end to a closed perforate lower end thereof; and (f) an eating tray that is moveable between a dining position substantially flush with said dining surface and a storage position within said dishwasher so as to be washed simultaneously on both of opposite sides thereof.

14. A combination dining table with integral dishwasher, comprising:

(a) a support base having a top portion;

(b) a substantially horizontal dining surface fixedly mounted on said top portion of said support base;

(c) a dishwasher assembled within said support base and connected to appropriate utilities for operation thereof;

(d) an access cover adapted for assuming a first stationary position in which said access cover resides adjacent and forms an extension of said dining surface and a second stationary storage position in which said access cover resides below the level of said dining surface and outwardly of an upper opening to said dishwasher;

(e) a perforate chute mounted within said dishwasher and configured for receiving and holding a plurality of utensils, said chute extending downwardly from an open upper end located below said access cover first position to a closed perforate lower end thereof; and (f) an eating tray that is moveable between a dining position substantially flush with said dining surface and a storage position within said dishwasher so as to be washed simultaneously on both of opposite sides thereof.

* * * * *